United States Patent [19]

Näslund

[11] 4,173,331

[45] Nov. 6, 1979

[54] METHOD AND ARRANGEMENT FOR STAYING CLIMB RODS FOR CO-OPERATION WITH SO-CALLED CLIMBING JACKS

[75] Inventor: Sören Naslund, Lidköping, Sweden

[73] Assignee: Paul Anderson Industrier AB, Vesteras, Sweden

[21] Appl. No.: 805,384

[22] Filed: Jun. 10, 1977

[30] Foreign Application Priority Data

Jun. 11, 1976 [SE] Sweden ..... 7606712

[51] Int. Cl.[2] ..... B66F 1/00

[52] U.S. Cl. ..... 254/105

[58] Field of Search ..... 254/105–111; 52/167

[56] References Cited

U.S. PATENT DOCUMENTS 3,347,002 10/1967 Penkuhn ..... 52/167

3,349,418 10/1967 Meir ..... 52/167

3,845,934 11/1974 Andersson ..... 254/105

*Primary Examiner*—Robert C. Watson

*Attorney, Agent, or Firm*—Sughrue, Rothwell, Mion, Zinn and Macpeak

[57] ABSTRACT

A method of staying climb rods for co-operation with so-called climbing jacks by utilizing masts, preferably lattice masts, each of which climb rods is capable to carry vertical forces transferred via associated climbing jacks, while horizontal forces acting on the climb rod are transferred to the staying mast. The method comprises the steps of supporting the staying mast pivotally on a footing permitting the mast to pivot slightly in any direction, and attaching the climb rod slidably to the staying mast so as to render possible relative movements in the vertical direction between the rod and the mast. The invention also relates to an arrangement for staying climb rods in accordance with the method set forth.

9 Claims, 4 Drawing Figures

Figure 1:
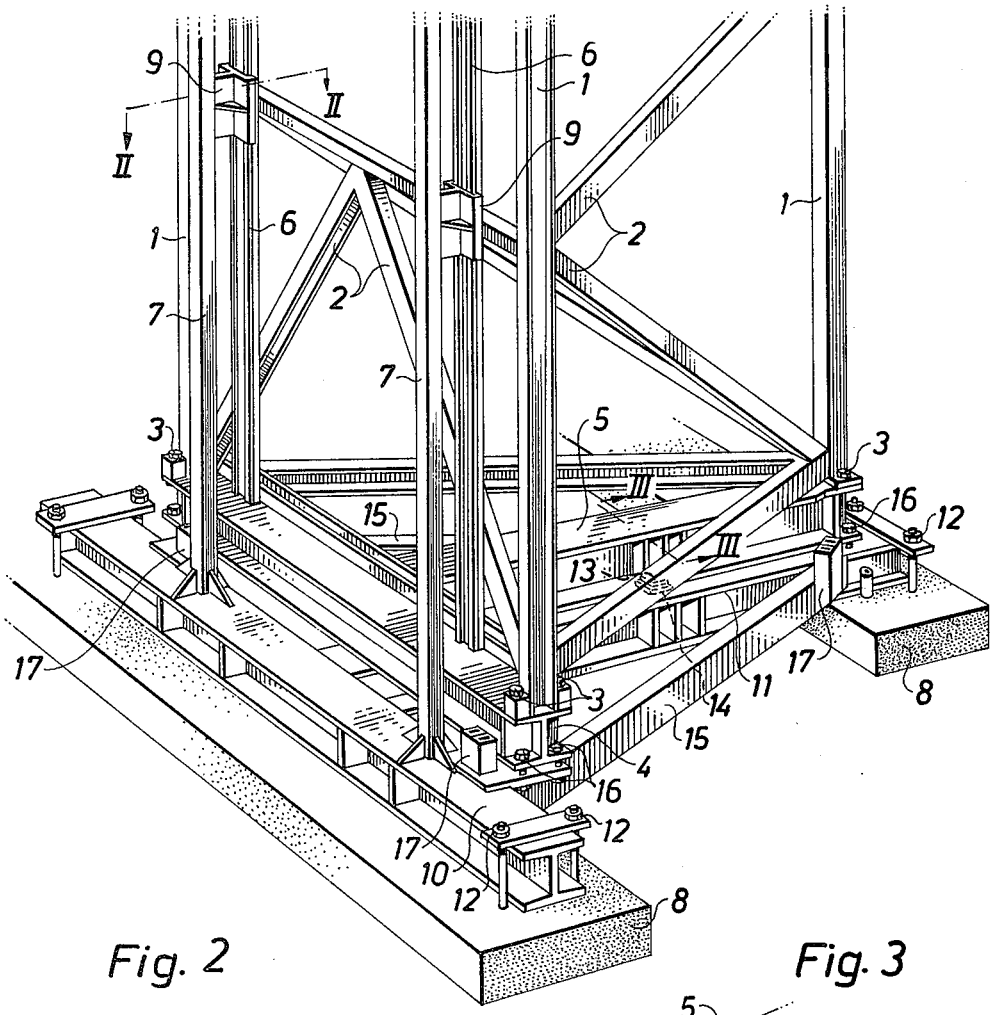

METHOD AND ARRANGEMENT FOR STAYING CLIMB RODS FOR CO-OPERATION WITH SO-CALLED CLIMBING JACKS

Closest prior art: U.S. Pat. No. 4,053,138.

This invention relates to a method of staying climb rods intended to be used in co-operation with so-called climbing jacks by utilizing masts, preferably lattice masts, each of which climb rods is capable to carry vertical forces transferred via associated climbing jacks, while horizontal forces acting on the climb rod are transferred to the staying mast. The invention also relates to an arrangement for use in connection with such staying of climb rods. The invention particularly has the object to prevent fixed end moments from arising in the staying mast.

When heavy objects, particularly such having a large extension in the plane, for example girders for cranes, are to be lifted to or lowered from great heights, in many cases climbing jacks are used which are capable to move by steps in one or the other direction along a climb rod. The entire load carried by a jack is transferred to the associated climb rod which is supported on a footing provided on the ground.

As said climb rods are relatively slender they must be stayed in the horizontal direction by masts in order to prevent the rods from being bent with resulting risk or breakage. These masts must be mounted and dismounted, respectively, in connection with each lifting operation and, therefore, it is desired to design the masts as light-weight and handy mounting sections. The masts, therefore, preferably are designed as light-weight lattice work structures.

It is, however, in this connection of great importance to prevent to the greatest possible extent the rise of moments in the masts. Unavoidably moments will arise due to the action of the wind force on the mast and to the carried load, as well as the theorectically calculated moments which the masts must be capable to take up in order to render the climbing rods as rigid as necessary. Moments, however, which can and ought to be eliminated are such, which originate form settlements in the footing of the climbing rod and/or mast and from differences in tension of the stay wires of the mast.

The main object of the invention is to provide a method and an arrangement for the staying of climb rods for climbing jacks by means of masts which minimize the moments arising in the mast.

This object is achieved according to the invention by supporting the staying mast pivotally on a footing permitting the mast to pivot slightly in any direction, and attaching the climbing rod slidably to the staying mast so as to permit relative movements in the vertical direction between the rod and the mast.

Due to the pivotal mounting of the mast settlements in the mast footing, different staying tensions and wind forces among other things are prevented from giving rise to fixed end moments at the mast base. Owing to the sliding connection of the climb rod to the mast, the mast can pivot slightly in any direction without moments being transferred between the mast and climb rod. The sliding mounting of the climb rod, further, implies that the vertical force caused by the load and acting on the associated climbing jack is transferred downward into the footing by means of the climb rod and, thus, does not load the staying mast.

In a preferred embodiment the staying mast is arranged on a frame structure assembled of beams and supporting said frame structure pivotally in a single central point by an underlying support footing which preferably also is designed as a frame assembled of beams. Means are provided to prevent relative rotary movement between the frames connected via the pivot point. For use in connection with a staying mast of triangular crosssection said frame structures are substantially T-shaped and the pivotal load-transferring connection between the frames preferably is designed as a combined support and pivot dowel on the beam of one frame corresponding to the vertical leg of the T-shape and a corresponding guide provided on the opposite surface of the corresponding beam of the other frame.

In order to facilitate the mounting of the mast said frames are designed so that they temporarily can be clamped to each other to stabilize the mast sections at least until the first set of stay wires of the mast can be mounted.

Further features characterizing the invention become apparent from the attached claims.

Figure 2:
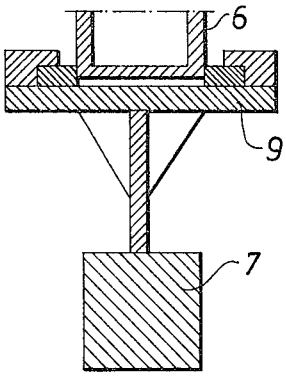
Figure 3:
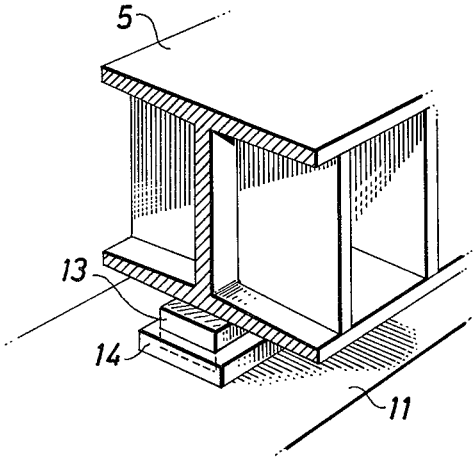

The invention is described in greater detail in the following with reference to the accompanying drawing, in which FIG. 1 shows the lower portion of a staying mast with climb rods according to the invention, FIG. 2 is a section along the line II—II in FIG. 1 through a climb rod and associated guide bar, and FIG. 3 is a section along the line III—III in FIG. 1 through a beam in the carrying frame of the mast at the pivotal connection to the footing frame.

Figure 4:
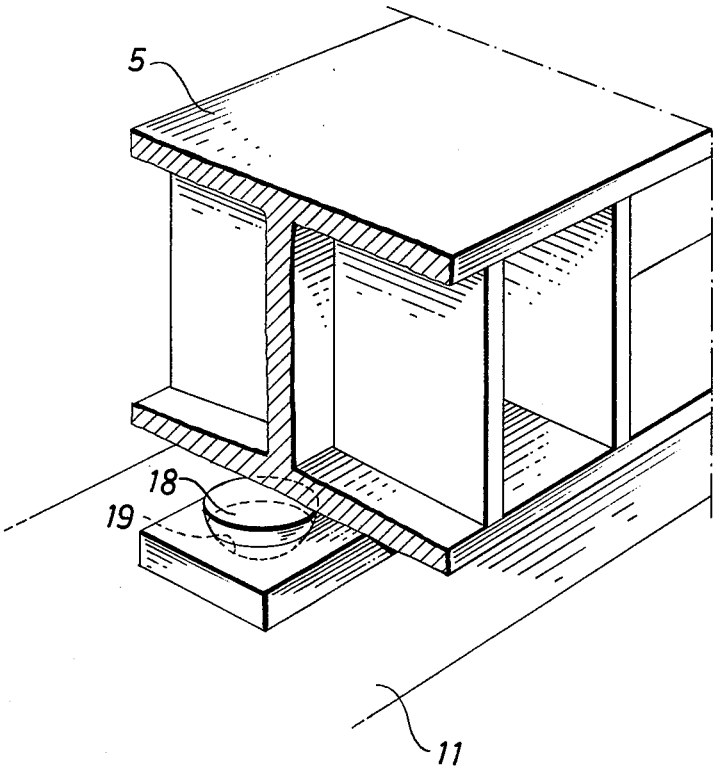

FIG. 4 is a view similar to FIG. 3 showing a modified pivotal connection.

In FIG. 1, the numeral 1 designates the vertical uprights in a triangular staying mast of known lattice-work structure with transverse struts 2. The uprights 1 are fixed by means of bolts 3 at the ends of two I-beams 4 and 5 welded together to a T-shaped carrying frame.

At one side of the mast two vertical guide bars 6 are attached. Outside of the respective guide bar 6 a climb rod 7 is provided to co-operate with a climbing jack (not shown). The climb rods are supported on a footing 8 provided on the ground and are slidingly connected to the respective guide bar 6 by means of slide shoes 9 fixedly attached in a certain spaced relationship along the climb rods 7. The co-operation between a slide shoe 9 attached to a climb rod 7 and a guide bar 6 is apparent in detail from the section shown in FIG. 2.

The carrying frame 4, 6 of the mast is supported in a single point of a corresponding T-shaped footing frame assembled of I-beams 10 and 11 which frame via bolt means 12 is fixedly attached to the footing 8. The footing frame further comprises two diagonal stiffening U-beams 15. The pivot point which in operative position is the only connection between the carrying frame 4,5 of the mast and the footing frame 10, 11 comprises a dowel 13 projecting from the lower surface of the beam 5 of the carrying frame of the mast and a corresponding guide 14 provided on the upper surface of the beam 11 of the footing frame. The design of the force-transferring pivot point 13, 14 provided between the beams 5 and 11 is shown in detail in FIG. 3.

In FIG. 1 bolts 16 are used for temporarily clamping the mast frame to the footing frame during the mounting of the mast, in any case until the mast has been assembled to such a height that the first set of stay wires can be mounted. During a lifting operation, however, said bolts are removed and the only connection between the frame 4, 5 supporting the mast and the footing frame 10, 11 and 15 is via the dowel 13. The numeral 17 designates means adapted during the balancing of the mast on the dowel 13 to prevent relative rotary movement between the mast frame and the footing frame.

By utilizing an arrangement according to FIG. 1 in which the staying mast due to the single point support can pivot or sway slightly relatively to the footing frame the risk of fixed end moments arising in the mast is eliminated. When, for example, settlements occur in the footing beneath the mast they should not give rise to fixed end moments in the base portion of the mast as is the case when the mast is rigidly connected to the footing. The footing frame, instead, will sway slightly relatively to the mast frame and form a certain angle thereto. In the same way, wind forces acting upon the mast or load will not give rise to moments in the base portion of the mast but be taken up by the stay wires thereof.

The function described above also requires the climb rods be slidingly connected to the mast, as shown, so as to permit relative movement between them in the case of settlements in the footing or swaying of the mast. The climb rods can be positioned on the mast footing or on a separate footing as said connection between the rods and the mast also permits settlements of the footing beneath the climb rods without detrimental forces being transferred to the mast.

On the drawing the climb rods are shown fixed to the footing frame. The rods, however, may also be arranged so as to render possible a certain small horizontal movement between the base portion of the mast and the climb rods. Each climb rod, for example, can be provided with a joint at the level of the mast base to permit a certain movement in horizontal direction.

The arrangement described above can be varied in several respects within the scope of the claims the essential features of which are the pivotal connection of the mast to the footing, and the sliding connection of the climb rod to the mast. An other suitable support means for the mast than the dowel shown in FIG. 3 may be a segment of a sphere 18 on one frame 5 and a corresponding bearing cup 19 on the other frame 11 as shown in FIG. 4. The design of the frames, furthermore, can be varied in several respects and must be adapted among other things to the mast configuration. The footing frame may be abandoned entirely and the mast be positioned directly on a spread-out foundation. Beam sections can be chosen as desired depending on the load. The desired pivotal support of the mast can be obtained also in another way, for example by cardanic suspension.

What is claimed is:

1. A method of staying climb rods for co-operation with so-called climbing jacks by utilizing masts, each of which climb rods is capable to carry vertical forces transferred via associated climbing jack, while horizontal forces acting on the climb rod are transferred to the staying mast, comprising the steps of supporting the staying mast pivotally at a single pivot point on a footing centrally located beneath the mast permitting the mast to pivot slightly in any direction, and attaching the climb rod slidably to the staying mast so as to render possible relative movements in the vertical direction between the rod and the mast.

2. A method according to claim 1, including the steps of arranging the staying mast on a frame structure assembled of beams, and supporting said frame structure pivotally in a single central point by an underlying footing.

3. An arrangement for staying climb rods for co-operation with so-called climbing jacks by utilizing masts, each of which climb rods is capable to carry vertical forces transferred via associated climbing jack, while horizontal forces acting on the climb rod are transferred to the staying mast, wherein the staying mast is pivotally supported at a single pivot point on a footing centrally located beneath the mast permitting the mast to pivot slightly in any direction, and the climb rod is slidably attached to the staying mast so as to permit relative movements in the vertical direction between the rod and the mast.

4. An arrangement according to claim 3, wherein the staying mast is arranged on a frame structure assembled of beams, and said frame structure is pivotally supported in a single central point by an underlying footing.

5. An arrangement according to claim 4, wherein said frame structure is supported on a similar frame structure resting on said footing, and means are provided to prevent relative rotary movement between the frames.

6. An arrangement according to claim 5 intended to be used in connection with a staying mast of triangular cros-section, wherein said frame structures are substantially T-shaped.

7. An arrangement according to claim 6, wherein a combined support and pivot dowel is provided in the beam of one frame corresponding to the vertical leg of the T-shape, and a corresponding guide is provided on the opposite surface of the corresponding beam of the other frame.

8. An arrangement according to claim 7, wherein said support and pivot dowel has the form of a segment of a sphere, and said guide is a corresponding bearing cup.

9. An arrangement according to claim 5, wherein means are provided for temporarily clamping the two frames to each other.

* * * * *